United States Patent [19]

Oosthuizen et al.

[11] Patent Number: 4,842,274

[45] Date of Patent: Jun. 27, 1989

[54] EXERCISE APPARATUS

[76] Inventors: Albertus D. Oosthuizen; Janusz K. Buczkowski; Teresa Buczkowska; Joanne A. Buczkowska, all of 48 Hamilton Street, Lane Cover, Australia, 2066

[21] Appl. No.: 145,742

[22] Filed: Jan. 19, 1988

Related U.S. Application Data

[63] Continuation of Ser. No. 835,115, filed as PCT AU85/00129 on Jun. 14, 1985, published as WO86/00024 on Jun 3, 1986, abandoned.

[30] Foreign Application Priority Data

Jun. 14, 1984 [AU] Australia ..... PG5504

[51] Int. Cl.[4] ..... A63B 21/24

[52] U.S. Cl. ..... 272/129; 272/125

[58] Field of Search ..... 272/72, 129, 130, 125

[56] References Cited

U.S. PATENT DOCUMENTS

| | | | |
|---|---|---|---|
| 3,869,121 | 3/1975 | Flavell | 272/129 |
| 3,874,659 | 4/1975 | Aharoni | 272/132 |
| 4,082,267 | 4/1978 | Flavell | 272/129 |
| 4,184,678 | 1/1980 | Flavell et al. | 272/129 |
| 4,261,562 | 4/1981 | Flavell | 272/129 |
| 4,337,050 | 6/1982 | Engalitcheff, Jr. | 272/130 |

*Primary Examiner*—Leo P. Picard

*Attorney, Agent, or Firm*—Armstrong, Nikaido, Marmelstein & Kubovcik

[57] ABSTRACT

An exercise apparatus comprises a variable speed rotary driving device which generates a torque having a magnitude dependent on its speed of rotation; an adjustable speed control which controls the speed of rotation of the rotary driving device; an exercise element, mainpulable by a user; and a torque transmission which transmits torque from the rotary driving device to the exercise element so as to resist manipulation of the exercise element and to allow for lost motion between the rotary driving device and the exercise element. The torque transmission transmits torque, from the rotary driving device to the exercise element, of a magnitude substantially independently of the motion of the exercise element and dependent upon the speed of rotation of the rotary driving device.

23 Claims, 10 Drawing Sheets

EXERCISE APPARATUS

This is a continuation of Ser. No. 835,115, filed as pct Aug 5/00129 on Jul. 14, 1985, published as W086/00024 on Jan. 3, 1986, now abandoned.

BACKGROUND OF THE INVENTION

The present invention relates to an exercise apparatus and more particularly, but not exclusively, to a programmeable exercise apparatus.

Resistance training is used for strength, muscular endurance and aerobics, speed and power, muscle toning and body-building. It is generally accepted that when training to improve any of the above, the exercise regimen must be based on the overload principle, i.e. the muscles of the body must be forced to work against greater resistance than that to which they are normally accustomed. The resistance may be isometric, isokinetic (sometimes called variable) or isotonic depending on the purpose of exercise.

Resistance training is typically performed in groups of repetitive exercise movements, wherein each group of movements is called a set and each repetitive movement is called a repetition. Within a single exercise repetition resistance may be applied to concentric (positive) movement and/or eccentric (negative) movement. The magnitude of the concentric and eccentric movements may be varied independently. For example, it has been found that in certain types of exercise, significant strength increases are obtained if the eccentric resistance is increased over the concentric resistance.

Within an exercise set the resistance may be varied from repetition to repetition. For example, the resistance may be progressively increased over the first repetitions and then decreased over the later repetitions. This is sometimes referred to as pyramiding.

Many combinations of movements and resistive forces are possible and the best effect is achieved when the combination is tailored to the application, with applications such as professional body building, rehabilitation and sport or leisure exercises having differing requirements. For optimum results the exercise apparatus should be set for each particular type of exercise activity and in order to minimize the cost, one piece of equipment should cover the widest possible field of applications.

An important part of any exercise programme is the ability to monitor its progress by way of suitable indications related to duration of the exercise, number of movements executed, energy expended and other useful information. Availability of such feedback information not only enables the progress of the exercise programme to be monitored and controlled simply, but may also be a positive encouragement to the user.

Exercise apparatus currently available use a variety of principles to achieve resistance against which the user must exert himself. Two most common groups of equipment available on the market make use of weightstacks and free weights. Used also in various specific designs are: pneumatic cylinders, hydraulic cylinders, friction devices, electromagnetic brakes, resilient bands and/or springs etc. used singly or in various combinations.

Probably the most popular principle is that which makes use of a weightstack in conjunction with cables, pulleys and levers in order to provide resistance to an operator's muscular movements and efforts.

In equipment making use of a weightstack, it is an advantage that the stack will apply a given force against which the operator must exert himself, almost independently of movement. However, it is a disadvantage of the weightstack that there is an inertia to be overcome, thereby increasing the load on the user when upward weightstack movement is first initiated, or if the weights are accelerated. The resilient bands and springs employed as alternatives to the weightstaks have the disadvantage that the force applied to the operator varies in accordance with the elongation of the resilient bands or springs. It is a disadvantage of the other devices, such as pneumatic cylinders, used as alternatives to weightstacks that the resisting force encountered by the operator depends on the speed at which they are operated, as opposed to the almost constant gravitational force provided by the weightstack.

A substantial disadvantage usually associated with each of the above methods of providing resistance is that they do not provide any feedback information to the user about the progress of the exercise programme. Also, it is not known in equipment using the above methods to provide a pre-programmed varying combination of resistances during the course of exercise while at the same time providing one piece of equipment which covers a wide range of applications. Rather, if any change in resistance is desired, the exercise must be stopped temporarily and suitable adjustments made, after which the exercise programme may be resumed. Such a disruption to the continuity of the exercise is most undesirable. As an alternative, a second person may be used to manipulate the resistance of the exercise apparatus, but this method requires constant presence of the second person and is prone to errors in adjustment. Many attempts have been made to design exercise apparatus with some degree of programmability but to date it is not known for such a piece of apparatus to cover a complete range of applications, while at the same time providing features closely approximating those of the weightstack.

Numerous patents have been issued in the past, which disclose various parts or equipment within the exercise apparatus field. U.S. Pat. No. 3,998,100 to Pizatella et al covers the use of computer control to vary and regulate only the operating speed of the exercising device. U.S. Pat. No. 3,848,467 to Flavell refers to the partially programmed exercising machine, but the programmed control covered only the end points of the exercising strokes. Many other specifications disclose the control of speed of movement, examples of which are U.S. Pat. Nos. 3,465,592 and 3,784,194 to J. J. Perrine for mechanical and hydraulic devices used for speed control. Centrifugal control devices are described in the U.S. Pat. Nos. 3,640,530 and 3,896,672 to Henson et al. An electronic and electromechanical servo system is shown in the Wilson U.S. Pat. No. 3,902,480 and Flavell U.S. Pat. Nos. 3,848,467 and 3,869,121. U.S. Pat. No. 4,354,676 to G. B. Ariel shows a combination machine using a hydraulic cylinder as a source of resistance combined with computerised control and displays. This design, however, is limited to linear movements imposed on it by the use of the hydraulic cylinder/piston combination.

It is the object of the present invention to overcome or substantially ameliorate one or all of the above disadvantages and/or shortcomings.

SUMMARY OF THE INVENTION

The present invention consists in an exercise apparatus comprising a driving device, an exercise element to be directly or indirectly manipulated by a user and driven by the driving device, and torque transmitting means coupling the said driving device and exercise element so as to allow for lost motion therebetween.

In a preferred form of the present invention, there is provided an exercise apparatus including an electric motor, a hydraulic clutch driven by said motor, and a drum rotatably driven by the clutch, the drum receiving a flexible cable which is pulled by the user when working against the torque transmitted via said clutch from the motor during an exercise programme. The effective torque developed by said motor is proportional to the speed of revolution of the motor, this speed being controlled by a suitable motor speed controller. Thus, by varying the speed of the motor the torque developed will vary and so will the resistance presented to a user who pulls on the cable. While the speed of the driving device is high relative to the speed of the drum, such that the speed differential is relatively constant, the torque developed and in turn the resistance presented to the user will remain substantially constant. In this mode of operation the apparatus approximates very closely the behaviour of a weightstack.

The motor speed controller can in turn be regulated by a computer programme which holds all relevant information concerning particular exercise to be executed. Further, as the resistance can be controlled by the computer programme, by way of the speed of the motor and the transmitted torque, it is possible to programme any value of the resistance for each movement in the positive or negative direction. It is also a simple matter to programme the computer to provide a gradually increasing or decreasing resistance, or any other desirable resistance profile.

To provide the user with information relevant to the exercise performed, a comprehensive display is provided containing information on exercise progress, elapsed time, expended energy, etc. Data pertinent to the exercise performed is collected by the computer from information existing in the system and also from the sensor coupled to the drum. This sensor detects the drum movement and transmits signals representing positive and negative movements to the computer. Installed internally in the computer is an electronic clock which provides time pulses used by the computer to measure duration of a specific exercise or part of it. Data collected by the computer during the course of exercise may be reviewed and discarded or it may be stored for future reference.

The basic resistance controlling mechanism of the present invention can be used in a variety of frames which are commonly used in the field of exercising, or it may be mounted in a specially designed, multipurpose frame.

The preferred embodiments of the present invention provides a programmeable exercise apparatus, allowing the user to programme a wide range of exercise patterns including patterns which make use of isotonic, isometric and isokinetic resistance and wherein the resistnce associated with positive (concentric) and negative (eccentric) movements of an exercise repetition can be determined independently, as may the resistances associated with each repetition of an exercise set. The preferred embodiment also provides comprehensive feedback of the user's performance and the progress of the exercise, and the apparatus closely approximates the behaviour of equipment based upon a weightstack.

BRIEF DESCRIPTION OF THE DRAWINGS

Embodiments of the invention will now be described, by way of example, with reference to the accompanying drawings in which.

DESCRIPTION OF THE PREFERRED EMBODIMENT

Figure 1:
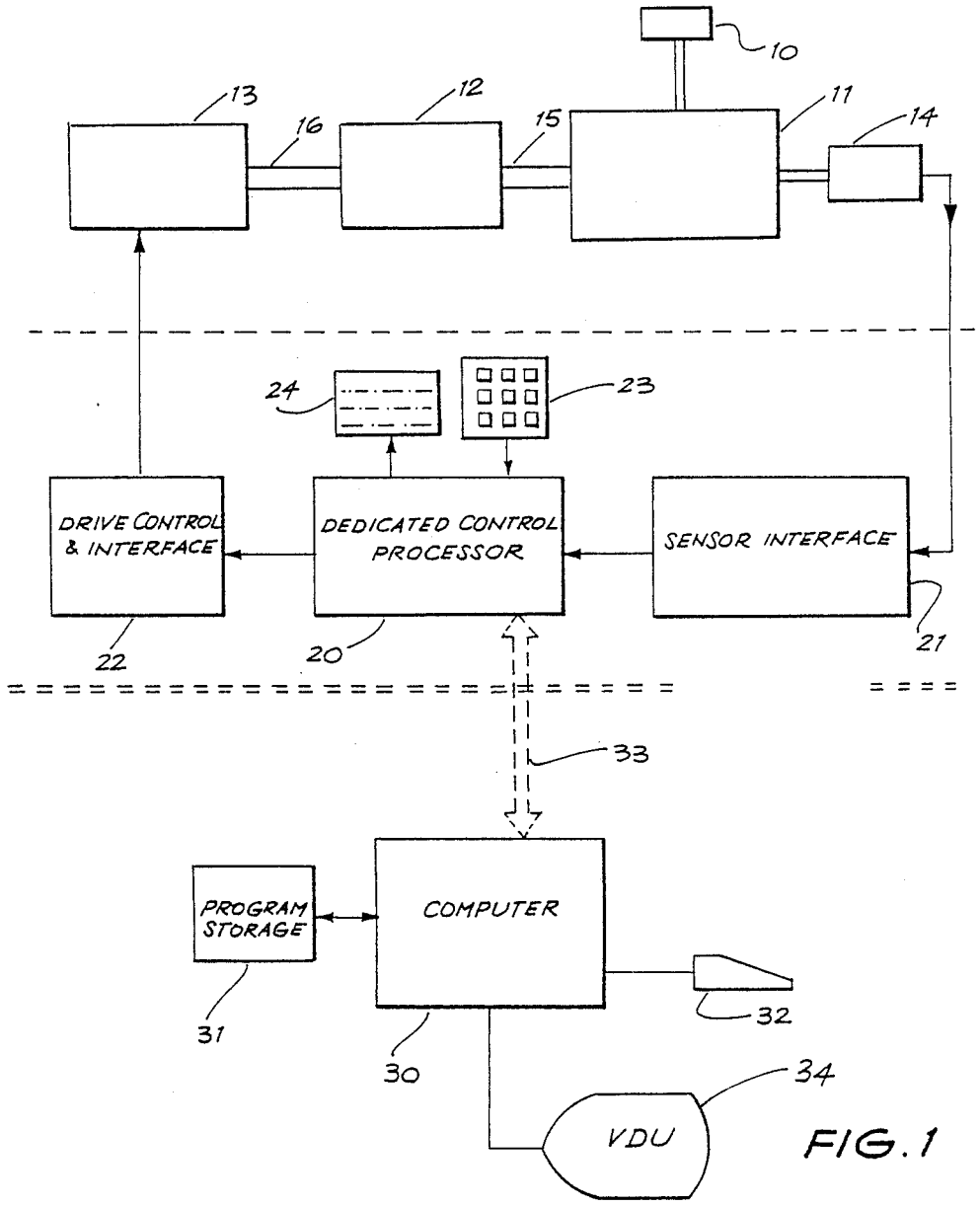
FIG. 1 illustrates a simplified block diagram of an embodiment of the invention.

A programmeable exercise apparatus constructed in accordance with one embodiment of the present invention is shown in the diagram of FIG. 1. In this drawing there is an exercise element which is operated by an operator in any appropriate manner. In general, a user interface 10 is provided to enable operation of the exercise element 11 which is driven by a coupling device, preferably an hydraulic clutch 12. The coupling device 12 is in turn driven by a driving device 13 which is preferably an electric motor but which might also be a pneumatically or hydraulically driven device. Preferably the coupling device 12 operates so that the torque applied to the exercise element 11 via shaft 15 is reasonably constant for a given speed of the drive. Also the coupling device 12 is constructed so that even if the exercise element 11 is halted, the drive 13 and the coupling device input shaft 16 would continue to rotate. By controlling the speed of the drive 13, the torque applied to the exercise element 11 can be determined using the transfer characteristic of the coupling device 12 and therefore, by suitably controlling the operating conditions of the drive 13, an exercise programme can be produced which is designed to meet specific requirements of the particular user, that is to say, by increasing the speed of the drive 13, a greater torque is applied to the exercise element 11, thereby requiring a greater effort on the part of the user. The use of the electric drive 13 has the advantage in this application that it is easily controlled either remotely or locally.

The exercise apparatus is provided with a sensor 14 which produces a signal representative of the speed and/or direction of movement of the exercise element 11.

The sensor output signal is transmitted to a dedicated control processor 20, such as a "single chip" microprocessor, via a sensor interface 21, thereby allowing the control processor to monitor the set of exercises being performed and to control the drive device 13, via a drive control and interface 22, to vary the resistance experienced by the operator in accordance with a predetermined exercise programme which has been entered into the processor 20. The processor 20 also processes the signal received from the sensor 14 to generate information relating to the number of exercise repetitions, direction and speed of movement, etc. Feedback from sensor 14 is used by the processor 20 to produce a variety of information relevant to the exercise performed, this information being displayed to the user.

A keypad 23 is connected to the control processor 20 to enable entry of control parameters defining a set of exercises, while a display device 24, also connected to the processor 20, enables display of the data as it is entered, in order that it might be verified. The display device is also used to display information relating to the rate at which exercises are being performed, as a form of feedback to the user.

A predefined set of exercises can also be loaded into the control processor 20 from a separate, and possibly remote, computer 30 via a suitable interface and data communications link 33. In this way, the parameters for a large number of individual sets of exercises may be defined and stored in a storage device 31 associated with the computer 30, and recalled and loaded into the control processor 20 at will. The computer 30 would typically be a personal computer and the storage device 31 would typically be a disk drive or tape recorder, capable of storing digital data. Control of the computer 30 is via a Keyboard 32 through which new exercise parameters may be entered and existing parameters altered. The computer 30 can also be used to store data relating to a user's performance for future reference and comparison.

It will be obvious to persons skilled in the art that many types of electric motors may be used as the drive device 13 to drive the coupling device 12. In the present embodiment of the invention the drive device is an AC induction motor.

Figure 2:
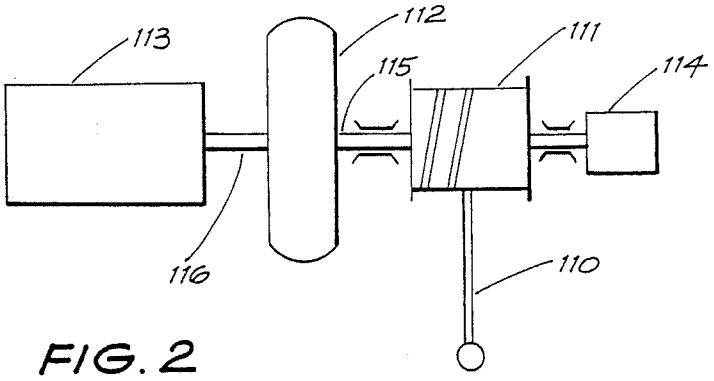
FIG. 2 schematically illustrates a first embodiment of the mechanical component of an exercise machine made in accordance with the present invention.
Figure 3:
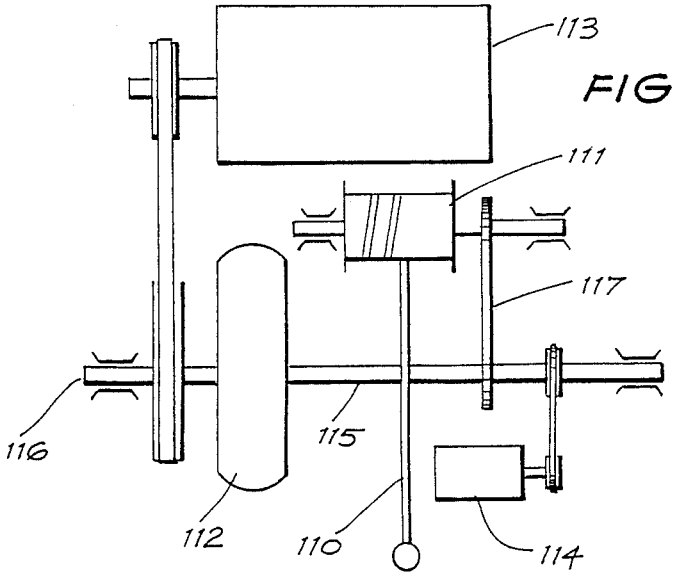
FIG. 3 schematically illustrates a second embodiment of the mechanical component of an exercise machine made in accordance with the present invention.

Referring to FIGS. 2 and 3, in the illustrated embodiments of the invention, the coupling device is a fluid type coupling commonly referred to as a hydraulic clutch 112. The torque transmitted by the clutch 112 is proportional to the speed of revolution of the driving shaft 116 and it allows the output shaft 115 to stop while the driving shaft 116 is still rotating, without any damage to the equipment. The physical size of the clutch 112 will depend upon the desired range of torque to be transmitted, while the internal design of the clutch is typical and well known to those skilled in mechanical engineering. The clutch included in the present embodiment of the invention uses a constant level of fluid inside the clutch, however, an alternative is possible in which a hydraulic clutch with variable fluid level may be used.

In the embodiments of FIGS. 2 and 3, the exercise element is a drum 111 on which a flexible rope or cable 110 is wound, one end of the cable being attached to the drum 111 and the other being pulled directly by the operator or being connected to a further interface mechanism such as a set of levers and handlebars. It will be recognised, however, that a set of levers could equally be connected directly to the output shaft of the clutch 112.

The rotation of the shaft 115 with the drum 111 on which the rope 110 is wound is monitored by the sensor 114 coupled directly to the shaft or alternatively via a chain drive, toothed belt, meshing gears or other suitable means of transmission 117. In these embodiments, the sensor 114 is a DC generator which transmits a signal to the control interface circuitry via connecting wires. The polarity of the voltage generated by the sensor 114 depends upon the direction of shaft rotation caused by the motion of the rope 110 which is pulled and released by the user, the generated voltage being present at the output of the generator only during shaft rotation (rope 110 movement), while the magnitude of the voltage generated is proportional to the speed of shaft rotation. Those skilled in the art will recognise that many other types of sensors, or combinations of sensors, may be used to transmit the relevant shaft rotation data, e.g. bidirectional incremental encoders, binary shaft position encoders (optical or mechanical), AC tachometer generators, etc. may be used with only slight modification to the control interface circuitry but without affecting the main principle of operation of the present invention. Operation of the motor 113 and thus of the rest of the apparatus is controlled by programme stored in the control processor 20. The programme running in the control processor 20 will receive from the user suitable instructions concerning the type of the exercise to be performed, the desired resistance, the number of repetitions, etc. and it will control the speed of the motor 113 accordingly, at the same time receiving information from the sensor 114 as to the progress of the exercise.

All data received is constantly processed to provide parameters which are presented to the user on a suitable display device (LED, LCD, etc.) 24 (refer to FIG. 1) or alternatively the parameters may be presented on a video screen or VDU display 34 associated with the computer 30. It will be apparent to those skilled in the art that any computer may be used as the control processor 20 which directly controls the operation of the apparatus, and examples of suitable types of processor are a single board microcomputer, a personal microcomputer, a minicomputer or a single chip microprocessor with inbuilt RAM and EPROM. However, with reference to FIG. 4, the control processor 120 will preferably be a dedicated single board microcomputer which makes use of a single chip microprocessor. In the preferred embodiment, the single board microcomputer will include provision for connection to a communications link 133 whereby it can be programmed from a remote computer 130 such as a personal computer or mini computer system.

The complete operation of the exercise apparatus in the preferred embodiment of the present invention will now be described with reference to the block functional diagram in FIG. 4. To begin, the user must enter into the control processor 120 details relating to the exercise set which the user wishes to perform. This information may be entered through the dedicated keypad 123 according to an exercise pattern held in an EPROM associated with the control processor 120, as one of a group of predefined basic exercise sets. Alternatively, the desired exercise set may be prerecorded on a mass storage medium such as tape or disk associated with a remote computer 130 and loaded into the control processor 120 via the communications link 133. Details of the exercise data entered into the control processor 120 can be presented on the dedicated display 124, or when the computer 130 is connected, the same data may be presented on a VDU display 134 associated with the remote computer 130, or it may be displayed on home television equipped with a suitable adaptor.

After receiving the complete set of information required to control the exercise set, the control processor 120 displays a prompt indicating its readiness for use. At this stage the user may press the "GO" button (not shown) and will position himself in the place and pose suitable for the exercise to be performed. After short delay, designed to allow the user to move into proper position, the control processor 120 transmits an initiating signal to the motor control interface 122. The motor control interface 122, upon receipt of the initiating signal, applies power to the electric motor 113 just sufficient for the motor to rotate slowly. This initial slow speed of the motor is designed to prepare the apparatus for normal operation, i.e. to remove any slack from the rope 110, and to start rotating the masses of the motor 113 and of the clutch 112. The initial slow rotation of the shaft with the drum is assumed to be in the negative direction and as such will cause the sensor to produce the voltage corresponding to negative movement and in this case it will not be recorded by the control processor 120.

When the user is ready to commence exercise he starts pulling the rope 110 in the positive direction. Positive movement of the rope is detected by the sensor 114 which transmits a signal representative of this motion to the control processor 120 via the sensor interface 121. In response to the detected positive movement, the control processor 120 immediately applies a signal to the motor control interface 122 corresponding to the predetermined resistance for the commencement of the exercise set. The motor 113 then changes its speed rapidly to the predetermined value which results in the appropriate torque being applied to the drum 111 and in turn the desired resistance being applied to the rope 110. Throughout the duration of the positive movement of the rope a signal is generated at the output of the sensor 114 and the parameters of this signal are monitored by the processor 120 via the interface 121. As soon as movement is completed, the sensor indicates to the processor 120 the completion of the positive motion and the processor then applies a signal to the motor control interface 122 to set the resistance to the value selected for negative movement. The resistance for negative movement may have been previously selected to be of the same value, smaller or larger than that for positive motion and the control processor resets the motor speed accordingly. In the meantime the user will commence negative movement. During negative movement the sensor 114 generates a signal representative of the movement which is monitored by the control processor 120. Upon completion of the negative movement the control processor registers one complete repetition, updates it's records and resets the speed of the motor 113 as required for the next positive movement. This sequence of events repeats itself until the prescribed number of repetitions has been completed. When the prescribed number of repetitions has been completed and if this corresponds to the end of the exercise set, the control processor applies a signal to the motor control interface 122 to lower the motor speed to the originally set idling speed, completes processing of data collected during the exercise programme and displays the results of the exercise, which would typically include the resistance selected, the number of repetitions set and performed, total time of exercise time for individual movements, and the value of energy expended, expressed in calories, on the display 124. At this stage the user may either abandon further exercises or may return to a main menu of the control processor and select another exercise.

In its simplest form the preferred embodiment of the invention will allow the user to set the exercise parameters, to perform the exercise and to read the final result of the exercise. After terminating the exercise session the data relating to the just completed exercises will usually be lost, although it will be apparent to those skilled in the art that the processor software could be altered without any great difficulty such that data relating to completed exercise sessions was stored for future reference, if this was required, provided that a suitable storage device were connected to the control processor 120. On the same basis, it is possible to prerecord one or a number of different exercise parameters and later load them into the memory of the control processor 120 and execute them in any order. In particular the function of prerecording and loading, may be achieved by using the computer 130 connected to the control processor 120 via the communications link 133, in which case, the exercise set may be defined on the computer 130 via the keyboard 132 and stored in mass storage 131. The newly created exercise set may also be added to a menu of previously recorded exercises and thereafter selected and loaded into the control processor 120 at will. Data relating to a completed exercise set may also be passed back to the computer 130 and displayed on the VDU screen 134. It will also be recognised that the computer 130 can be simultaneously connected to control processors of a number of different pieces of exercise equipment.

Typically, the parameters which will be displayed to the user on the display 124 would include the number of positive (outward) and negatie (inward) movements of the rope 110, or alternatively the number of completed repetitions. When the prescribed number of repetitions has been completed, marking the end of the exercise, all counters are stopped and the programme in the control processor displays the remaining part of information relating to the exercise set including total time elapsed for the exercise (in min. and sec.), total time during which an effort was being exerted (in min. and sec.) and calories expended by the user, calculated as a function of the magnitude of resistance (weight) and time of exercise. At the bottom of the screen, a prompt will appear, asking the user for an instruction as to whether the user wishes to perform another exercise or wishes to terminate the exercise session. In the first case he will be returned to the previously mentioned "Main" menu and in the second case the software will cause the session to be terminated in which case the parameters of the loaded exercise set may also be automatically unloaded. Similar displays may be provided on the VDU monitor **132*b* connected to the computer 130, although the display provided on the monitor 132** may also display additional information such as a comparison with a previously executed exercise set.

It will be apparent to those skilled in the art that substantially any desired sequence of exercises and type of resistance, whether isotonic, isometric or isokinetic, may be described in the programme of the control processor and that the exercise apparatus will allow the user to perform those exercises at any time.

Figure 5:
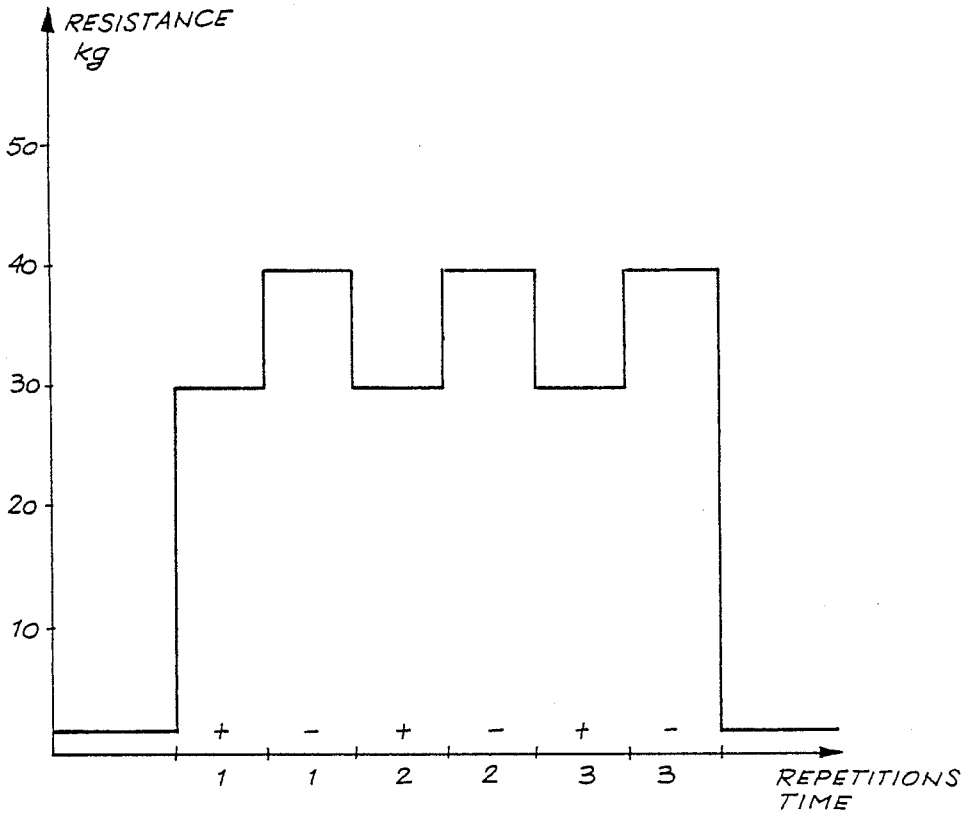
FIG. 5 graphically illustrates an example of resistance variation for positive (concentric) and negative (eccentric) movement in a simple exercise set.

FIG. 5 shows an example of the behaviour of the exercise apparatus while operating in a simple exercise routine consisting of a single set of 3 repetitions. The programme was set to provide 30 kg restoring force during positive movements and 40 kg during negative movements. It will be noted that after completion of the last (third) repetition the resistance presented drops to the minimal, idling value.

Figure 6:
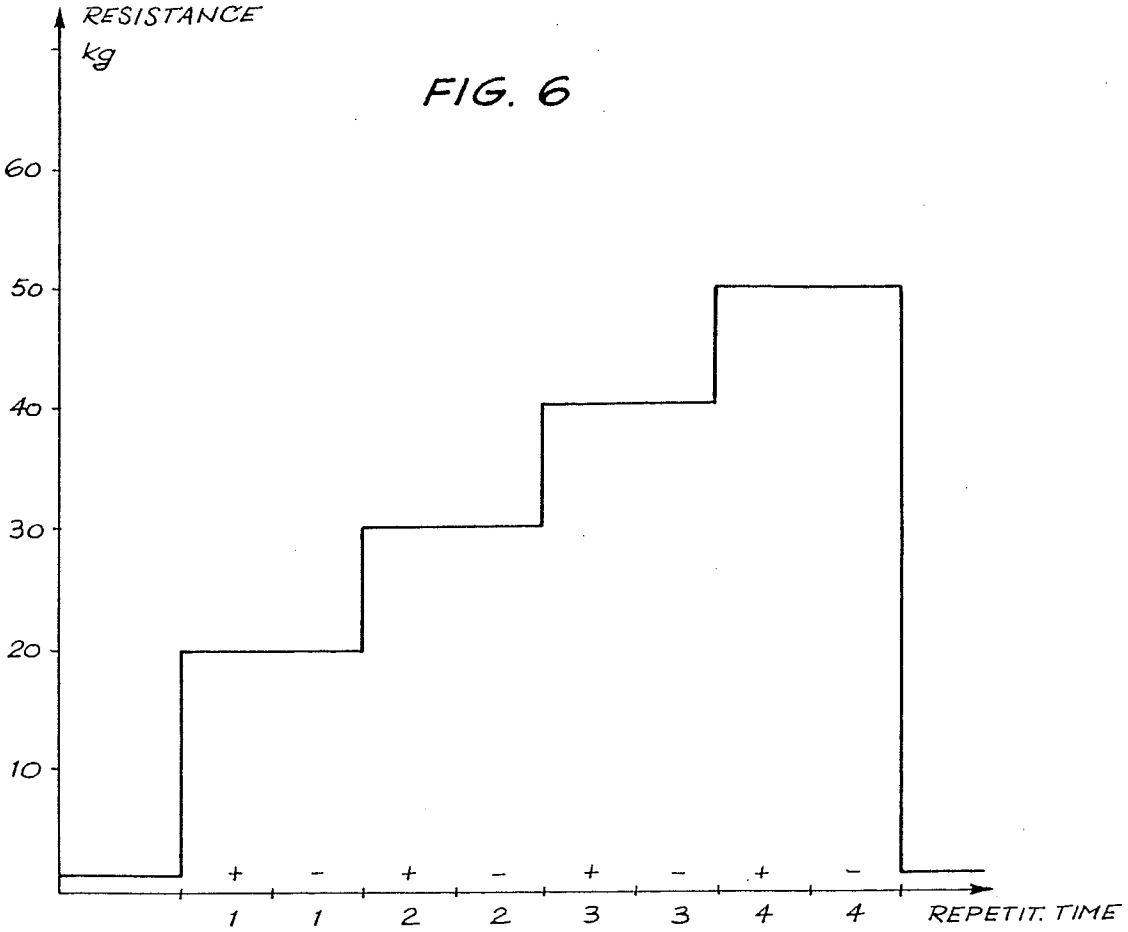
FIG. 6 graphically illustrates an example of pyramiding in an exercise set, wherein resistance is varied from repetition to repetition.

Another example of equipment versatility is shown in FIG. 6 where positive pyramiding was provided in the exercise programme. In this type of exercise, after each repetition (or number of repetitions) the resistance is increased in predetermined steps, building up to the desired maximum and again dropping down to the safe, idling value after completion of the predetermined set of exercises.

Figure 7:
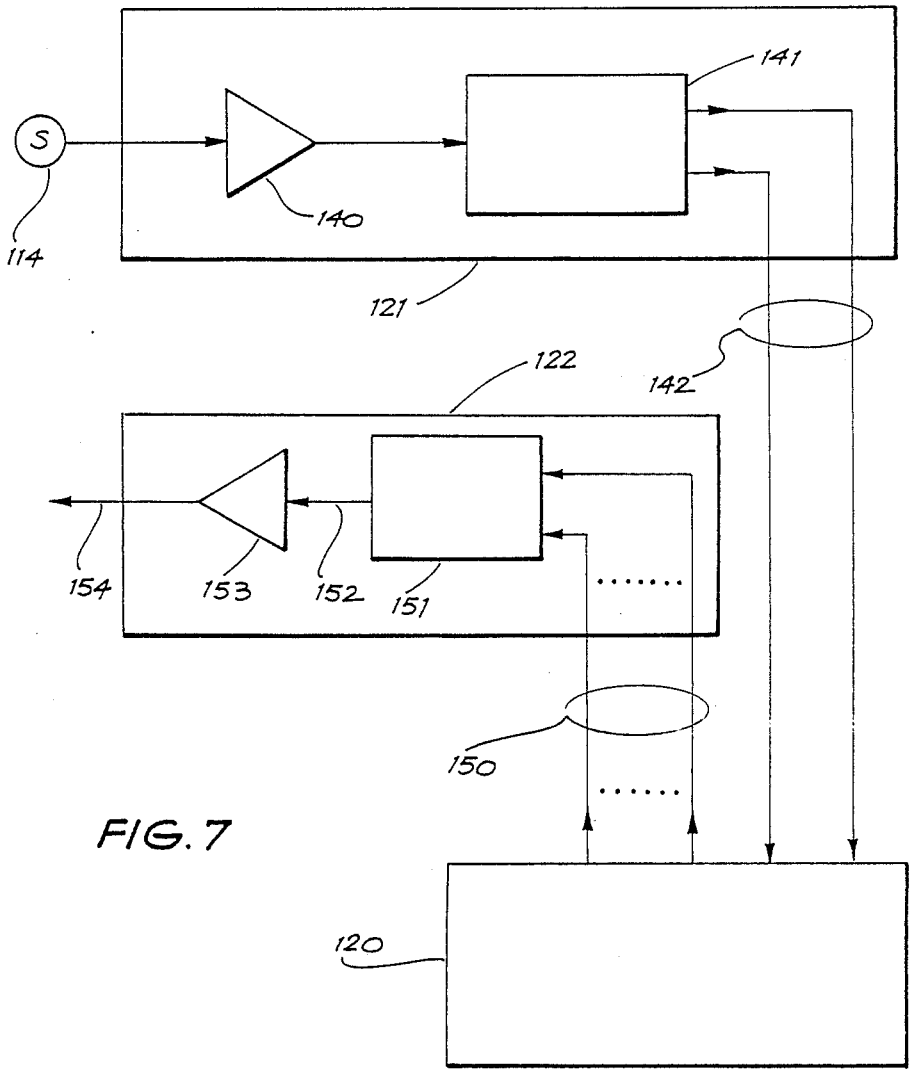
FIG. 7 illustrates a block diagram of the motor control interface and sensor interface of the preferred embodiment.

The setting of the resistance presented to the user is performed by the control processor 120 through the motor control interface 122. The processor generates a suitable binary combination which is converted by the motor control interface 122 into an electrical signal suitable for controlling of a motor speed controller 125. The functional organisation of an example of a sensor interface 121 and motor control interface 122 are presented in FIG. 7, wherein the sensor 114 generates a potential the polarity and magnitude of which are directly proportional to the direction of rotation and the speed of its rotation respectively. Thus the potential generated by the sensor 114 is amplified by the amplifier 140 and applied to the logic circuits 141 and directly represents the effort of the exercising user. Logic circuits 141 convert the potential received from the sensor into typical logic patterns and levels as required by the computer for its correct operation, and applies these signals to the control processor 120 via wires 142. The binary signals generated by the logic circuit 141 might, for example, comprise a first signal which only switches to the active state when the sensor 114 is moving in the positive direction and a second signal which only switches to the active state when the sensor 114 is moving in the negative direction. These signals may also carry information relating to the speed of the sensor 114. The control processor 120, in accordance with the parameters of the exercise set being performed, applies a binary combination via wires 150 to the digital-to-analog converter 151 which converts the binary combination and levels into an analog signal at its output 152, related to the binary value represented on wires 150. The analog signal 152 is then amplified by amplifier 153 and the output signal 154 is applied to the motor speed controller 125. It will be apparent that the accuracy of the speed setting, and thus accuracy of the setting of the resultant resistance, depends upon resolution of the digital-to-analog converter 151. If, for example, the digital-to-analog converter would cover the whole range of desired motor speeds in four steps only, this will result in a very crude speed adjustment changing in steps of 25%. A wide range of DAC converters are now commercially available and devices are available which will provide very high resolution if it is required. It will be apparent to those skilled in the art that essentially any commercially available DAC unit, most of which provide at least 8 bit accuracy, will provide sufficient accuracy to meet the requirements of the user of the present invention when coupled with a suitable commercially available motor speed controller 125.

Figure 4:
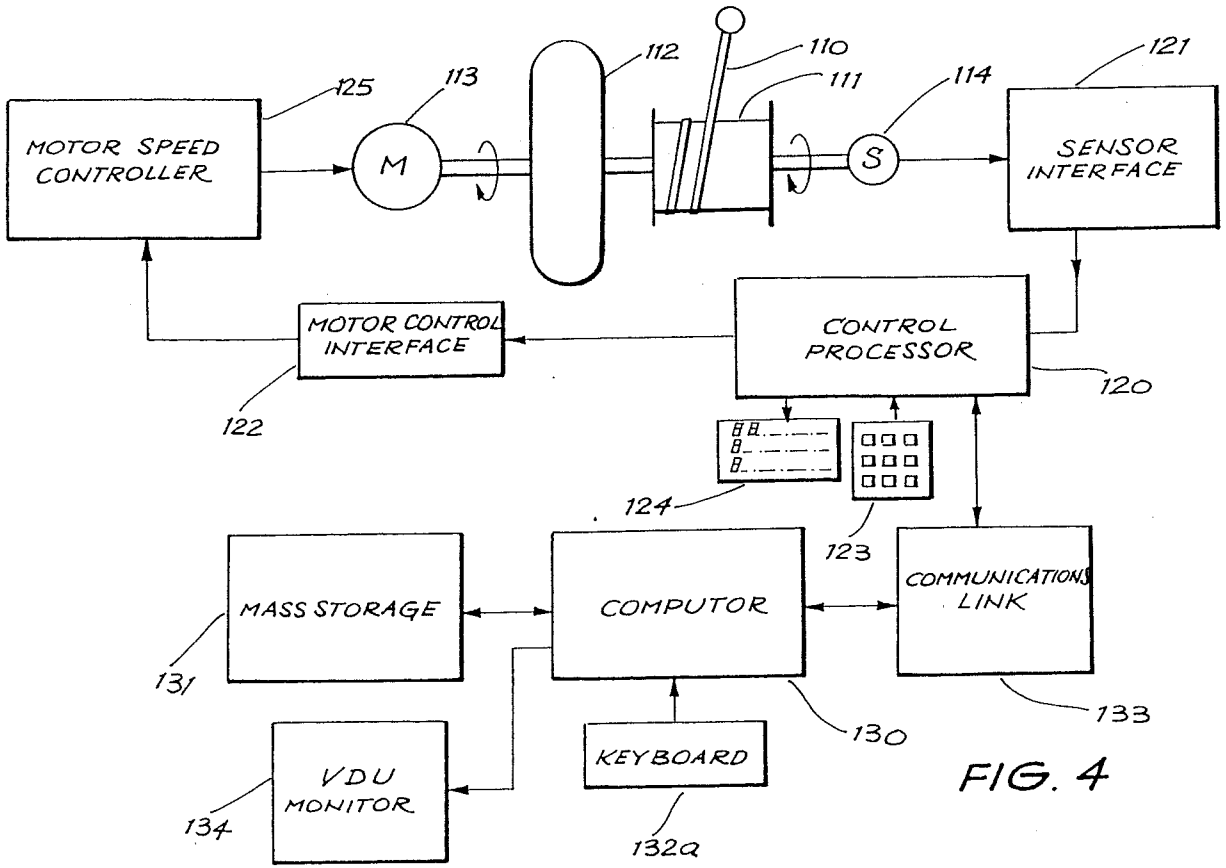
FIG. 4 illustrates a block functional diagram of the preferred embodiment of the invention.
Figure 8A:
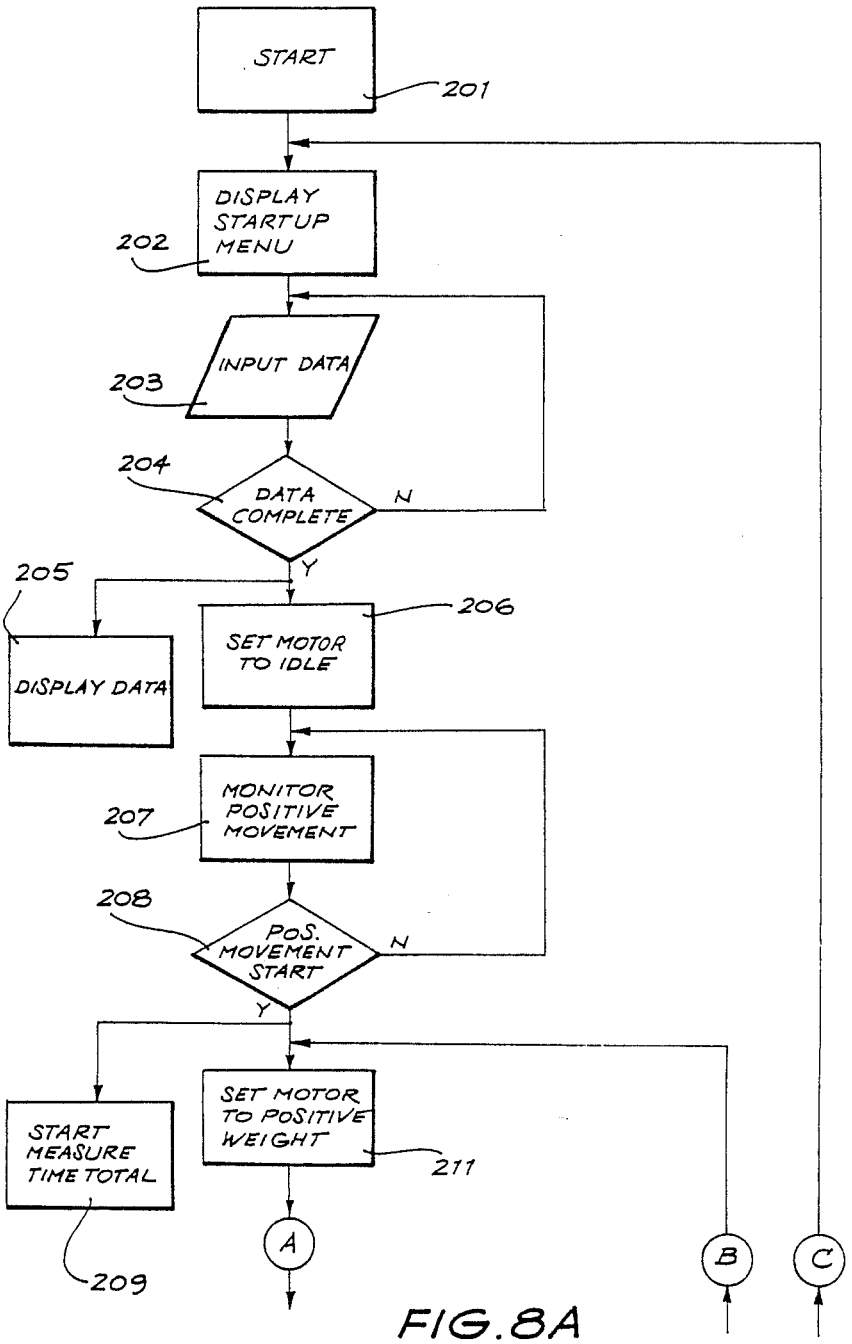
FIGS. 8A, B, C and D illustrate a flowchart of an example of an exercise control programme for the embodiment of FIG. 4.
Figure 8B:
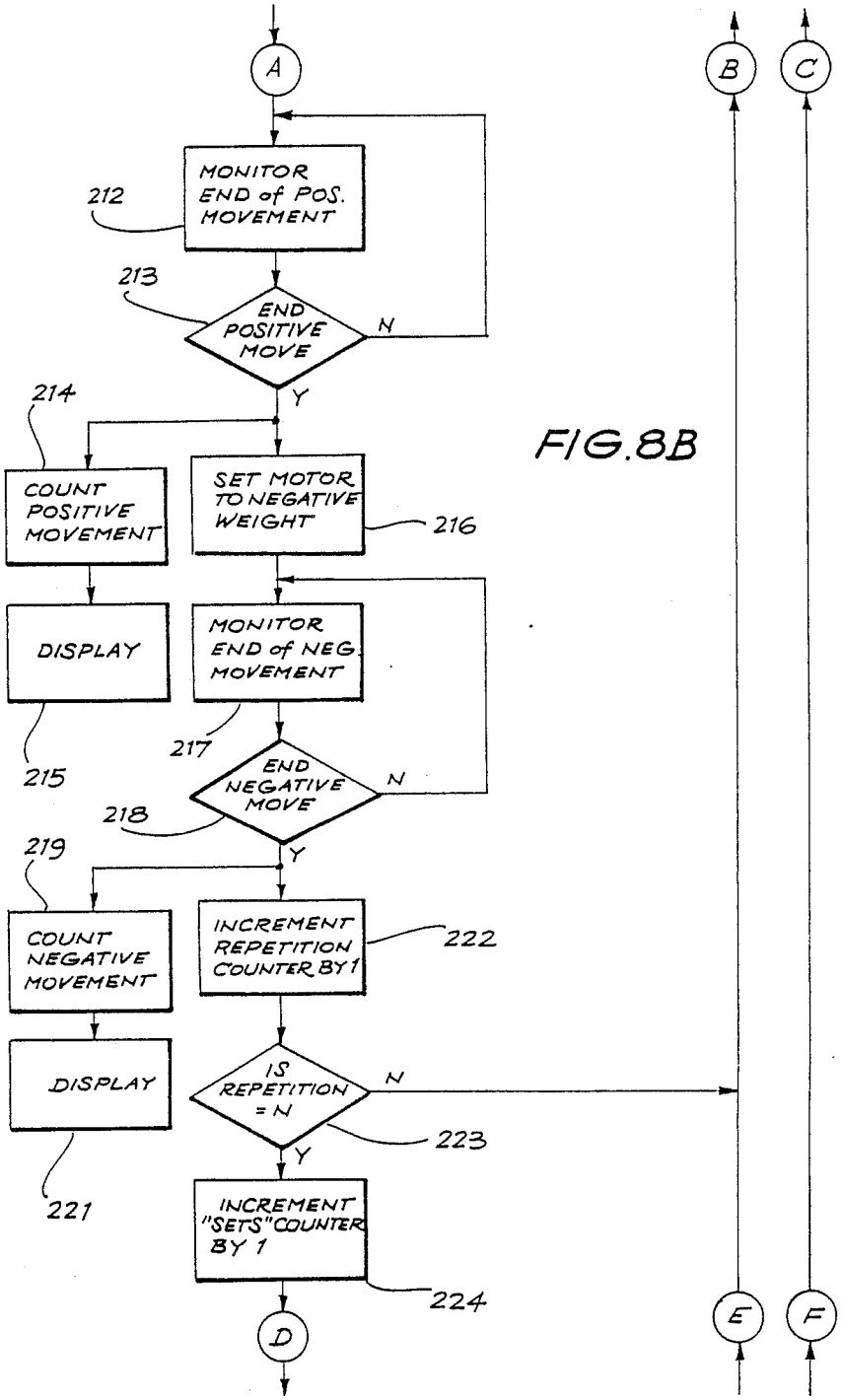
Figure 8C:
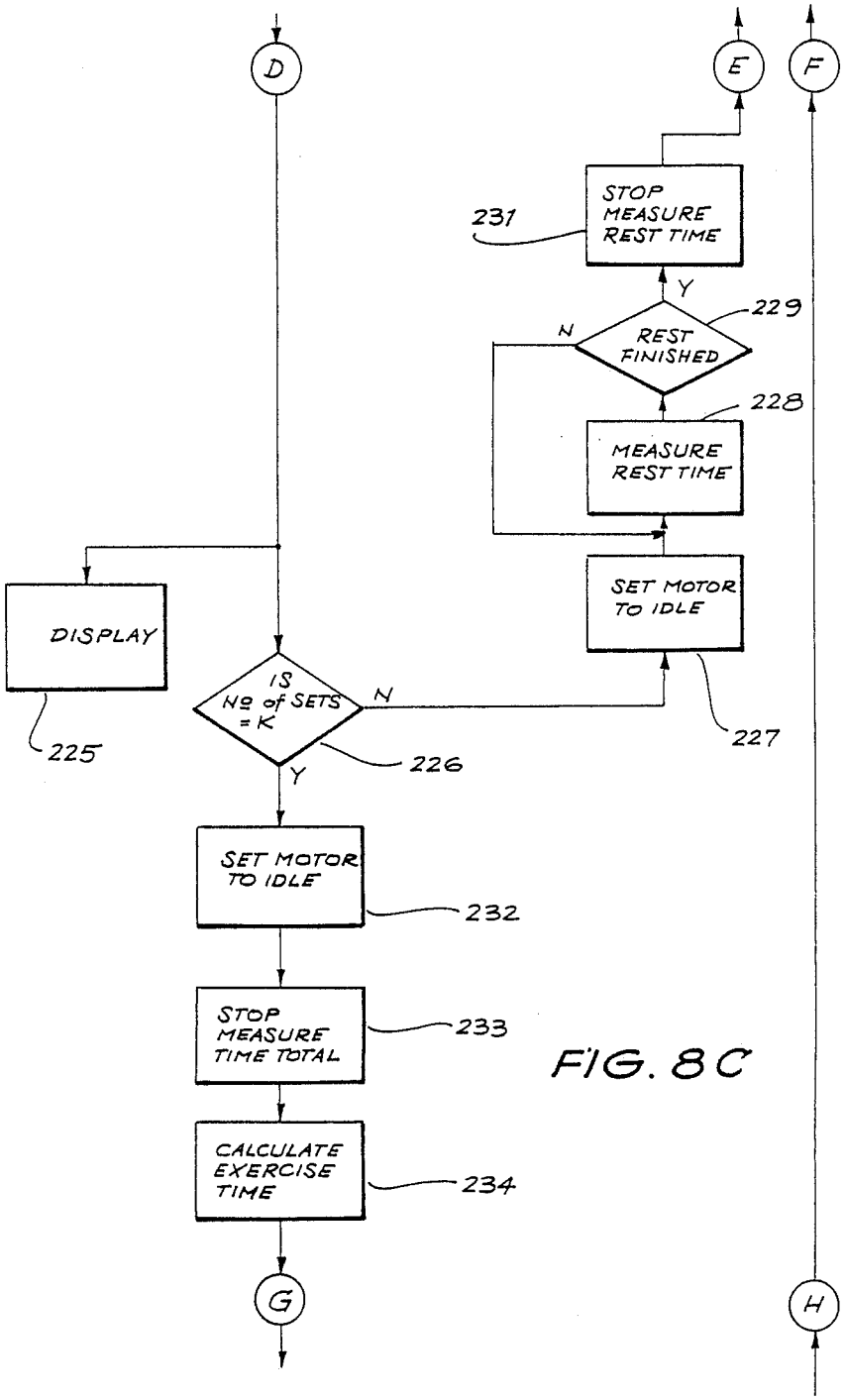
Figure 8D:
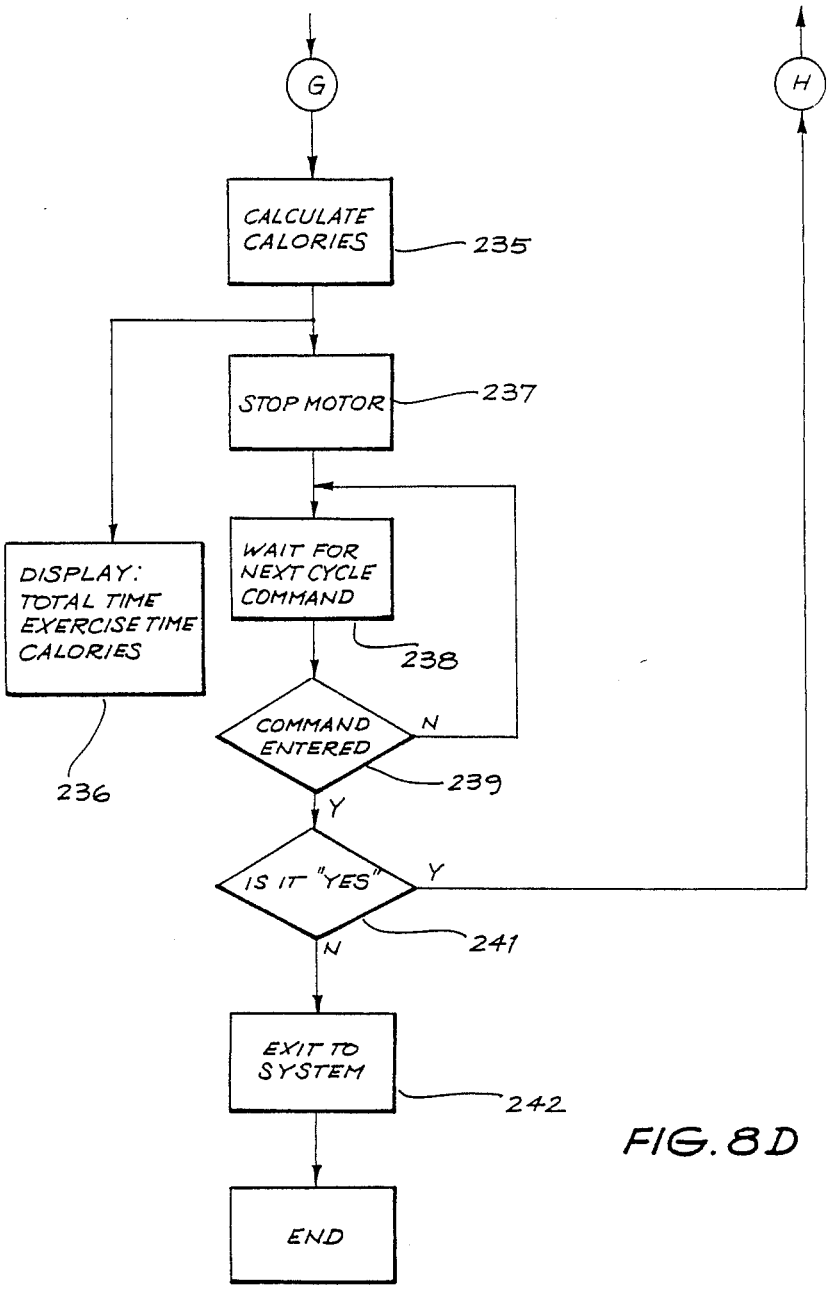

Referring now to FIGS. 8A, B, C and D, an example of a control programme for the control processor 120 of FIG. 4 is illustrated in the form of a flow diagram. The control programme of FIG. 8 is designed as a routine which exists within a main system programme from which it is called, the main programme being responsible for initialisation of the processor and the provision of functions such as the real time clock.

Upon entry into the exercise control routine at START 201 a menu of predefined exercise sets and variable exercise sets is displayed 202 on the display 124 and input data is accepted 203, 204 via the keypad 123 until such time as a complete programme of exercise sets has been defined. The chosen exercise sets are then displayed 205 on display 124.

Having defined a programme of exercise sets, the electric motor 113 is started 206 with its speed set to idle in order to take up any slack in the cable 110 and the signal from the sensor 114 is monitored 207, 208 until a positive movement indicates that the user has commenced to exercise. At this point the time of the commencement of the exercise set is noted 209 and a signal is applied 211 to the motor control interface 122 to run the motor at a speed corresponding to the chosen resistance for the first positive movement of the exercise set. The programme then monitors the sensor 114 until the end of the positive movement is detected 212, 213 at which time a positive movement counter is incremented, the incremented movement count is displayed 215 on display 124, and the motor speed is set 216 in accordance with the chosen resistance for the following negative movement of the exercise set. The sensor 114 is then monitored until the end of the negative movement 217, 218, when a negative movement counter is incremented 219 and displayed 221 and a repetition counter is incremented 222 and tested 223 to determine if the prescribed number of repetitions have been completed. If the prescribed number of repetitions has not been completed the motor speed is set 211 in accordance with the resistance chosen for the next positive movement and the repetition cycle 211–223 is repeated.

When the number of repetitions in an exercise set is equal to the prescribed number, a sets counter is incremented 224, displayed 225 and tested 226. If the number of sets completed is not equal to the number programmed, the motor is set to idle 227 and a rest period is measured 228, 229, 231, before setting the motor speed for the first positive movement 211 of the next set and repeating the set cycle 211–226.

When the programmed number of exercise sets has been completed the motor is again set to idle 232 and the total time for the exercises performed is calculated 233, 234 as well as the energy expended 235 and this information is then displayed 236 on display 124 and the motor is stopped 237. Having displayed the information relating to the completed exercises, the keypad is enabled 238, 239 to allow the user to select 241 between terminating the exercise session, in which case the exercise control routine is exited 242, or alternatively selecting further exercises in which case the startup menu is displayed 202 and the entire exercise routine 202–239 is repeated.

In the embodiment of the invention described with reference to FIGS. 2, 3 and 4, a cable 110 is employed to transmit the forces exerted by the user through the clutch 112 to the motor 113. It will be apparent to those skilled in the art that the force may be applied in alternative directions by making use of a suitable system of pulleys such that the direction of motion of the rope 110, and therefore of application of force by the user, may be changed at will.

The following advantages are among those obtained by the preferred embodiment of the present invention:

1. The equipment allows a choice to be made between isotonic, isometric and isokinetic resistance with a wide range of resistance increments.
2. The principle of operation of the apparatus allows positive (concentric) and negative (eccentric) movements to be performed with different resistance, a feature not normally offered by the ordinary weightstack equipment.
3. The functioning of the apparatus is fully programmeable and thus complex exercises such as pyramiding are possible.
4. The performance characteristics of the apparatus are able to be accurately controlled, and are therefore repeatable for successive users and training sessions. No special attention is required on the part of the user to achieve consistent performance of the equipment.
5. A single apparatus may be adapted to a variety of highly specialised exercises via simple programme changes. Previously, multiple devices were required to achieve this versatility.
6. Through gradual modifications of programme, athletes may be adaptively trained for optimum performance. Previously, apparatus having the required level of precision and consistency was not available.
7. In combination with suitable bio feedback displays, an athletes' performance may be controlled and analyzed, thereby permitting determination of the athletes abilities and suitability for particular type of exercise. Such analysis and assessment is not possible with the current exercise equipment.
8. The preferred combination of components for accomplishing these objectives of the preferred embodiment is not expensive to manufacture and assemble.
9. The absence of the heavy weightstack makes the equipment inherently safe to use and allows the equipment to be of relatively low overall weight, allowing it to be used in substantially any location without floor loading problems.
10. If desired, the speed of cable movement may be separately monitored so that if it exceeds a certain predetermined value in the negative direction, the motor may be turned off, thus removing resistance against which the user exerts himself. This unique feature may protect the user from serious injury if during an exercise high resistance exceeds performance of his muscles. Such protection is not achievable with the ordinary weightstack.

To those skilled in the art to which this invention relates, these and other advantages of this programmeable exercise apparatus will be apparent. Many changes in construction and widely different embodiments and applications will suggest themselves without departing from the spirit and scope of the invention.

We claim:

1. An exercise apparatus comprising:

a rotary driving means for generating a torque, said rotary driving means having a variable speed of rotation;

an adjustable speed control means, operably connected to said rotary driving means, for varying the speed of rotation of said rotary driving means;

an exercise element for manipulation by a user, said manipulation imparting a motion to said exercise element;

torque transmission means, operably connecting said rotary driving means and said exercise element, for providing a resistance to said user's manipulation of said exercise element and allowing for lost motion between said rotary driving means and said exercise element, said torque transmission means transmitting torque from said rotary driving means to said exercise element, said transmitted torque being of a magnitude that is substantially indepenent of said exercise element motion and is dependent only upon said speed of rotation of said rotary driving means.

2. The exercise apparatus of claim 1 wherein the driving device is an electric motor, the torque transmitting means is a fluid coupling and the exercise element is a drum about which an elongate flexible element is wound.

3. The exercise apparatus of claim 2 wherein the fluid coupling is a hydraulic coupling.

4. The exercise apparatus of claim 3 wherein the hydraulic coupling is a constant fluid level coupling.

5. The exercise apparatus of claim 3 wherein the hydraulic coupling is a variable fluid level coupling.

6. The exercise apparatus according to claim 2 wherein the speed of rotation of said electric motor is controlled by a motor control circuit in response to a motor control signal.

7. The exercise apparatus according to claim 6 wherein a sensing means is provided to monitor rotation of the drum.

8. The exercise apparatus of claim 7 wherein the sensing means is a tacho-generator.

9. The exercise apparatus of claim 7 wherein the sensing means is a shaft encoding device.

10. The exercise apparatus according to claim 7 wherein control means are provided, said control means being adapted to control said motor speed and to monitor an output signal of said sensing means, representative of the direction of rotation of said drum.

11. The exercise apparatus according to claim 10 wherein the sensing means output signal is also representative of speed of rotation of said drum.

12. The exercise apparatus according to claim 10 wherein the control means is responsive to the sensing means output signal to vary the speed of the electric motor in response to the direction of rotation of the drum.

13. The exercise apparatus of claim 12 wherein the control means is programmeable to control the motor speed during an exercise session such that effort required to be exerted by a user of the apparatus during the exercise session is varied according to a predetermined programme.

14. The exercise apparatus as claimed in claim 13 wherein the motor speed is varied for successive concentric and eccentric movements of the apparatus during a set of exercises.

15. The exercise apparatus as claimed in claim 13 wherein the motor speed is varied for successive repetitions of an exercise within a set of exercises.

16. The exercise apparatus as claimed in claims 13 wherein the control means includes storage means for storing statistics relating to an exercise session just completed or still in progress and display means for displaying the statistical information to the user.

17. The exercise apparatus as claimed in claim 16 wherein the control means is a computer.

18. The exercise apparatus as claimed in claim 17 wherein the display means comprises a set of alpha numeric display elements.

19. The exercise apparatus as claimed in claim 18 wherein the display means comprises a Visual Display Unit.

20. The exercise apparatus as claimed in claim 13 wherein the control means is programmed to provide a plurality of exercise programmes and includes input means to select one or more programmes to be performed, selected from said plurality of programmes.

21. The exercise apparatus as claimed in claim 20 wherein additional exercise programmes, apart from those held in the control means, may be defined and entered into the control means via said input means.

22. The exercise apparatus as claimed in claim 10 wherein the control means is adapted to respond to rotation of said drum in a negative direction at greater than a predetermined speed by stopping the electric motor.

23. An exercise apparatus comprising:

an electric motor having a variable speed of rotation;

an adjustable speed control means, operably connected to said motor for varying the speed of rotation of said motor;

an exercise element for manipulation by a user, said manipulation imparting a rotary motion to said exercise element;

torque transmission means, operably connecting said motor and said exercise element and allowing for lost motion between said motor and said exercise element, said torque transmission means transmitting torque from said motor to said exercise element so as to provide a resistance to said user's manipulation of the exercise element, the torque transmitted being of a magnitude that is substantially independent of said exercise element motion and is dependent only upon said speed of rotation of said electric motor.

* * * * *